US010034732B2

(12) United States Patent
Schmitt et al.

(10) Patent No.: US 10,034,732 B2
(45) Date of Patent: Jul. 31, 2018

(54) SANITARY SHEATH FOR A SYRINGE FOR INSEMINATION BY STRAW AND ITS METHOD OF MANUFACTURE

(71) Applicant: IMV TECHNOLOGIES, Saint Ouen sur Iton (FR)

(72) Inventors: Eric Schmitt, Villaines-la-Juhel (FR); Jean-Charles Gorges, Chenay (FR)

(73) Assignee: IMV TECHNOLOGIES, Saint Ouen sur Iton (FR)

( * ) Notice: Subject to any disclaimer, the term of this patent is extended or adjusted under 35 U.S.C. 154(b) by 343 days.

(21) Appl. No.: 14/647,464

(22) PCT Filed: Nov. 28, 2013

(86) PCT No.: PCT/FR2013/052881

§ 371 (c)(1),
(2) Date: May 27, 2015

(87) PCT Pub. No.: WO2014/083282

PCT Pub. Date: Jun. 5, 2014

(65) Prior Publication Data

US 2015/0297332 A1 Oct. 22, 2015

(30) Foreign Application Priority Data

Nov. 28, 2012 (FR) ..... 12 61355

(51) Int. Cl.
*A61D 19/02* (2006.01)

(52) U.S. Cl.
CPC ..... *A61D 19/027* (2013.01)

(58) Field of Classification Search
CPC ..... A61D 19/027
See application file for complete search history.

(56) References Cited

U.S. PATENT DOCUMENTS 4,701,164 A 10/1987 Cassou et al.
2004/0199044 A1* 10/2004 Verberckmoes ..... A61D 19/027 600/35
2005/0107659 A1 5/2005 Cassou
(Continued)

FOREIGN PATENT DOCUMENTS

FR 995878 A 12/1951
FR 2556596 A1 6/1985
(Continued)

*Primary Examiner* — Thaddeus Cox
(74) *Attorney, Agent, or Firm* — Browdy and Neimark, P.L.L.C.

(57) ABSTRACT

The sheath (30) comprises a tube (31) and an end piece (32) that comprises a foot (33) introduced into an end portion of the tube (31), and a head (34) arranged in the extension of the tube (31). The foot (33) comprises, on the outer surface (40) thereof, a plurality of annular ribs (41-44) facing the inner surface (45) of the tube (31). The head (34) comprises a shoulder (38) facing the section (39) of the tube (31), projecting over the root of the foot (33). The end piece (32) and the tube (31) are attached to the periphery of at least one of said annular ribs exclusively by intrinsic welding. The method comprises the step of carrying out a peripheral tightening of the outer surface (37) of the tube on a level with the ribs (41-44), and the step of applying a sonotrode to the outer surface (35-36) of the head (34).

6 Claims, 2 Drawing Sheets

(56) References Cited

U.S. PATENT DOCUMENTS

| | | | | |
|---|---|---|---|---|
| 2009/0234432 | A1* | 9/2009 | Pacetti | A61F 2/91 623/1.16 |
| 2010/0331610 | A1 | 12/2010 | Chen | |
| 2011/0251451 | A1* | 10/2011 | Anderson | A61D 19/027 600/35 |
| 2015/0112124 | A1* | 4/2015 | Yamane | A61D 19/04 600/34 |

FOREIGN PATENT DOCUMENTS

| | | | |
|---|---|---|---|
| FR | 2832919 | A1 | 6/2003 |
| GB | 669265 | A | 4/1952 |
| JP | H08280720 | A | 10/1996 |

* cited by examiner

SANITARY SHEATH FOR A SYRINGE FOR INSEMINATION BY STRAW AND ITS METHOD OF MANUFACTURE

FIELD

The invention concerns the artificial insemination of livestock with semen contained in a straw.

BACKGROUND

FIG. 1 of the accompanying drawings is a diagrammatic view in longitudinal cross-section of a straw for the preservation of a predetermined dose of liquid-based substance, in particular pure or diluted animal semen.

The straw 10 shown in FIG. 1 comprises a tube 11 and a stopper 12.

The tube 11 is conventionally made from extruded plastic material, with an inside diameter for example of 1.6 or 2.5 mm and a length of the order of 133 mm.

The stopper 12 is usually of the three-part type originally described in French patent 995 878, corresponding to British patent 669 265, i.e. formed by two plugs 13 and 14 made from a fibrous substance enclosing a powder 15 which, on contact with a liquid, is capable of transforming into an impermeable paste or gel adhering to the wall of the tube so that the stopper is liquid-tight.

In the initial state, shown in FIG. 1, the stopper 12 is arranged close to the end 16 of the tube 11 and it is provided that in the filled state, the dose of liquid substance which must be preserved in the straw 10 is placed between the stopper 12 and the end 17 of the tube 11 that is the furthest from the stopper 12.

In order to fill the straw 10, the end 16 is placed in communication with a vacuum source while the end 17 is placed in communication with a vessel containing the substance to be introduced into the straw.

The air initially contained between the stopper 12 and the end 17 is sucked through the stopper while the substance moves forward in the tube until it encounters the stopper 12, by the end 18 thereof that is turned towards the end 17 of the tube 11, that is to say the end of the stopper 12 that can be seen on the right in FIG. 1.

If necessary, the straw is welded close to one or both of its two ends 16 or 17 and is placed in cold storage.

In order to empty the straw 10, if necessary after cutting the welded end portions and thawing, there is inserted into the tube 11 a rod which comes to bear on the end 19 of the stopper 12 (which end is situated on the opposite side to the end 18). Using this rod, the stopper 12 is made to slide in the manner of a piston towards the end 17 or the end which corresponds after cutting the welded portion, which causes the expulsion of the dose of substance which had been introduced into the straw.

When the straw such as 10 is used for the artificial insemination of livestock, in particular bovine, ovine or caprine livestock, or rabbits, a reusable insemination syringe and a single-use sanitary sheath are used.

The insemination syringe comprises a rigid tubular body, for receiving the straw filled with semen, and comprises the rod for driving the stopper, slidingly mounted in the rigid tubular body.

Prior to insertion of the straw into the rigid tubular body, the rod is taken out or withdrawn as far as possible from the body at the proximal end, that is to say at the end which is manipulated by the inseminator during the operation, then the straw is inserted into the rigid tubular body at its distal end (the far end from the proximal end), the straw 10 being inserted with the end 16 of the tube 11 (the end closest to the stopper 12), first. The straw 10 is pushed into the rigid tubular body of the syringe until the end 16 of the tube 11 encounters a shoulder forming a pushing-in stop.

The straw 10 is then in place in the rigid tubular body of the syringe. The end 17 of the tube 11 as well as a certain length of the tube 11 starting from that end remain outside the rigid tubular body, that is to say that a certain part of the straw 10 projects beyond the distal end of the rigid tubular body of the syringe.

The sanitary sheath comprises a tube of which the inside diameter is such that the rigid tubular body of the syringe may be inserted therein. At one end (the proximal end) the tube of the sanitary sheath is open and at the other end (distal end) the sanitary sheath conventionally comprises a turned back edge forming a hem on the inside. Inside the sheath 3 a sliding sleeve member is disposed.

The rigid tubular body of the syringe, in which the straw was placed in advance, is inserted into the sheath by its open end with the straw first, the straw inserts into the sliding sleeve member and drives it. The insertion into the sheath ends when the sliding sleeve member and the straw come to bear against the hem-forming turned back edge situated at the distal end of the sheath (which is the far end to the open end of the sheath tube).

The sheath is then fastened to the rigid tubular body of the syringe, in general in the neighborhood of the proximal end of the sheath (open end of the tube) for example with a suitable ring.

The tube 11 of the straw 10 is thus immobilized relative to the assembly formed by the tubular body of the syringe and by the sanitary sheath fastened to that body, since the end 16 of the tube 11 bears against the shoulder of the tubular body of the syringe and the end 17 bears against the hem-forming edge of the sanitary sheath.

The assembly formed by the sanitary sheath and the syringe is then inserted into the animal and when that assembly is in place, the rod is used to make the stopper 12 of the straw 10 slide in order to eject the semen out from the tube 11 and out from the sheath tube by the aperture surrounded by the hem-forming edge.

The role of the sliding sleeve member is to provide liquid-tightness for the liquids between the straw tube and the sheath tube in order for the semen to be properly ejected out from the sheath (and not lost between the straw tube and the sheath tube).

French patent application 2 832 919, to which corresponds the United States patent US 2005/0107659 describes such a syringe and such a straw.

Sanitary sheaths are also known in which the sliding sleeve member and the hem-forming turned back edge are replaced by a tip attached to the tube by an insertion fit or by bonding This tip comprises a tail inserted into an end portion of the tube and a head disposed in line with the tube.

For the insertion fit between the tail and the end portion of the tube, the tail comprises annular ribs on its outside surface, facing the inside surface of the tube; the head comprising a shoulder facing the rim of the tube and jutting relative to the base of the tail.

The tip comprises a duct opening into the tube at the proximal end of the tail (the far end of the tail from the head) and out of the sheath at the outside surface of the head.

This internal duct of the tip comprises a portion oriented in the axial direction, narrowing from the proximal end of the tail, configured in order for the portion of the tube 11 of the straw 10 situated in the neighborhood of the end 17 (furthest end from the stopper 12) can enter the narrowing portion of the duct and advance to a stop position in which the portion of the tube 11 situated in the neighborhood of the end 17 is clamped around by the wall of that portion of the duct.

This clamping round provides at the same time the stop for the pushing-in of the straw into the sheath and the liquid-tightness between the straw and the sheath.

SUMMARY

The invention aims to provide a sanitary sheath of this type which is particularly reliable to use while being simple, convenient and economical to produce.

To that end the invention provides a sanitary sheath for a syringe for insemination by straw, comprising a tube and a tip attached to the tube, which tip comprises a tail inserted into an end portion of the tube and a head disposed in line with the tube, said tip comprising a duct opening into the tube at the proximal end of the tail and out from the sheath at the outside surface of the head, which duct comprises an axially oriented portion narrowing from the proximal end of the tail, said tail comprising on its outside surface a plurality of annular ribs facing the inside surface of the tube, said head comprising a shoulder facing the rim of the tube and jutting relative to the base of the tail; characterized in that the tip and the tube are exclusively fastened by intrinsic welding at the periphery of one or more said annular ribs.

Whereas in the sanitary sheaths already known the attachment between the tube and the tip is made by mere insertion fitting of the tip or else by bonding, in the sanitary sheath according to the invention, the tip and the tube are attached by intrinsic welding, that is to say with the material of the tube and the material of the tip, without addition of external material.

This is particularly secure, since the sheath according to the invention avoids the chemical hazards liable to be caused by adhesives, and in particular by the solvents which they contain, and also the hazards liable to occur of pulling off of the tip, in particular inside the animal during the insemination, with the sheaths of which the tip is merely fitted by insertion in the tube.

In addition, on account of the fact that the tip is welded to the tube exclusively by one or more of the annular ribs of the tail, that is to say that the welds are made exclusively inside the tube, none of these welds can create an edge liable to injure the animal.

It is to be noted in particular that in the sheath according to the invention, the rim of the tube and the shoulder of the head, which face each other, are not welded.

Were a weld to be present in that zone, there would be the risk of having flash outside the tube.

It is furthermore to be noted that the sanitary sheath according to the invention is capable of being produced simply, conveniently and economically.

According to preferred features:

- the tip and the tube are welded at the location of several said annular ribs, with a different depth of weld for at least two said annular ribs;
- the depth of weld is greater the further the annular rib is from the proximal end of the tail of the tip; and/or
- each said annular rib comprises, on the side turned towards the distal end, a straight surface which projects from a trough surface; and from the side turned towards the proximal end, a surface inclined inwardly and towards the proximal end.

According to a second aspect, the invention is also directed to a method for manufacturing a sanitary sheath as set out above, comprising:

- the step of providing a tube and a tip comprising a tail and a head, said tip comprising a duct opening at the proximal end of the tail and at the outside surface of the head, which duct comprises an axially oriented portion narrowing from the proximal end of the tail, said tail comprising on its outside surface a plurality of annular ribs, said head comprising a shoulder jutting relative to the base of the tail.
- the step of inserting the tail into an end portion of the tube until the head is disposed in line with the tube, the annular ribs then facing the inside surface of the tube, the rim of the tube facing said shoulder;
- the step of performing peripheral clamping on the outside surface of the tube opposite said ribs; and
- the step of applying a sonotrode for ultrasonic welding to the outside surface of the head.

According to preferred features, the outside diameter of said annular ribs varies from one rib to the other, increasing from the proximal end of the tail.

BRIEF DESCRIPTION OF THE DRAWINGS

The disclosure of the invention will now be continued by the description of an embodiment, given below by way of illustrative and non-limiting example, with reference to the accompanying drawings, in which.

DETAILED DESCRIPTION

Figure 1:
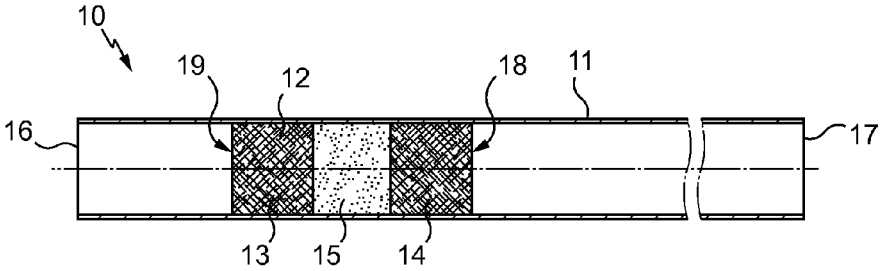
Fig. 1 (prior art)
FIG. 1 is a diagrammatic view in longitudinal cross-section of a straw according to the prior art.
Figure 2:
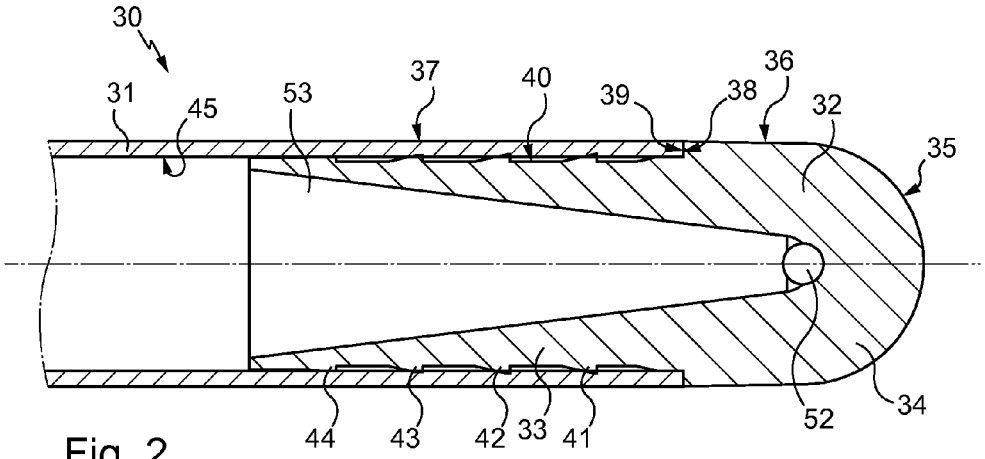
FIG. 2 is a cross-section view of the distal end of a sheath according to the invention.

The sanitary sheath 30 illustrated in FIG. 2 is provided to cooperate as explained above with an artificial insemination syringe in which is disposed a straw such as the straw 10 illustrated in FIG. 1.

The sanitary sheath 30 comprises a tube 31 and a tip 32.

The tip 32 comprises a tail 33 inserted into an end portion of the tube 31 and a head 34 disposed in line with the tube 31.

Remote from the tail 33, the head 34 has a rounded convex end surface 35 forming the distal end surface of the sanitary sheath 30.

The part 36 of the outside surface of the head 34 situated between the surface 35 and the tube 31 is here of circular section, of the same diameter as the outside surface 37 of the tube 31. Thus, the surfaces 36 and 37 are flush with each other.

The head 34 has a shoulder 38 facing the rim 39 of the tube 31 and jutting relative to the base of the tail 33.

The tail 33 comprises on its outside surface 40 annular ribs of which there are four here, referenced 41 to 44 in the order of proximity to the head 34, with the rib 41 the closest to the head 34 and the rib 44 the furthest away.

The attachment between the tube 31 and the tip 32 is achieved exclusively by intrinsic welding between the periphery of each of the ribs 41 to 44 and the inside surface 45 of the tube 31.

As explained below, these welds are made by ultrasound.

In the tip 32 there is formed a duct opening into the tube 31 at the proximal end of the tail 33 (the far end from the head 34) and outside the sheath at the outside surface of the head 34, here by two apertures 51 (FIGS. 3 and 4) situated at the junction between the portions 35 and 36 of the outside surface of the head 34.

The duct comprises a transversely oriented portion 52 going from one to the other of the apertures 51 and an axially oriented portion 53, disposed between the proximal end of the tail 33 and the portion 52.

The portion 53 of the duct narrows from the proximal end of the tail 33.

The portion 53 is configured such that the portion of the tube 11 of the straw 10 situated in the neighborhood of the end 17 (furthest end from the stopper 12) can be inserted into the portion 53 and advance to a stop position in which the portion of the tube 11 situated in the neighborhood of the end 17 is clamped around by the wall which delimits the portion 53.

This clamping round provides at the same time the stop for the pushing-in of the straw into the sheath and the liquid-tightness between the straw and the sheath.

Figure 3:
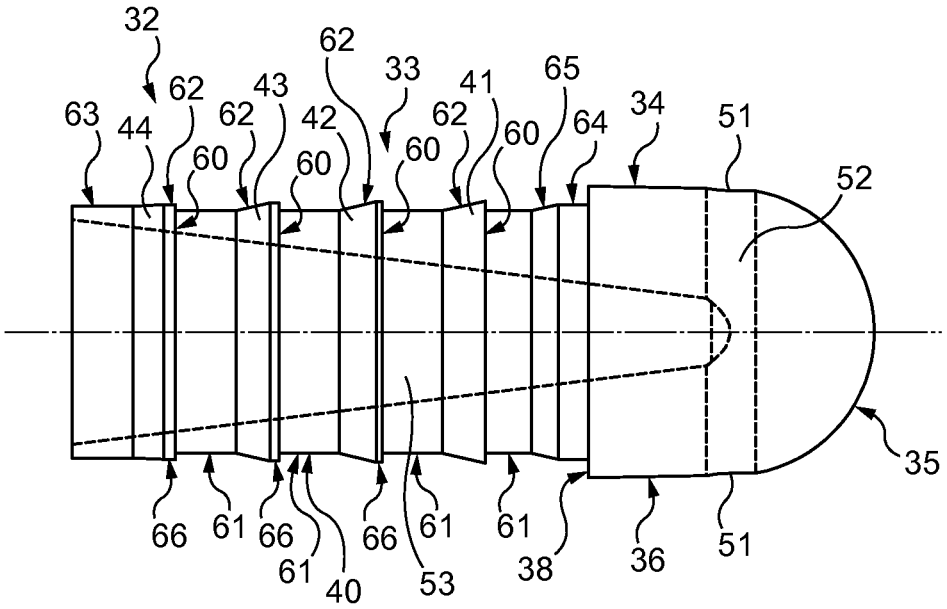
FIGS. 3 and 4 are side views of the head of that sheath, taken respectively from the top and from the front of FIG. 2.
Figure 4:
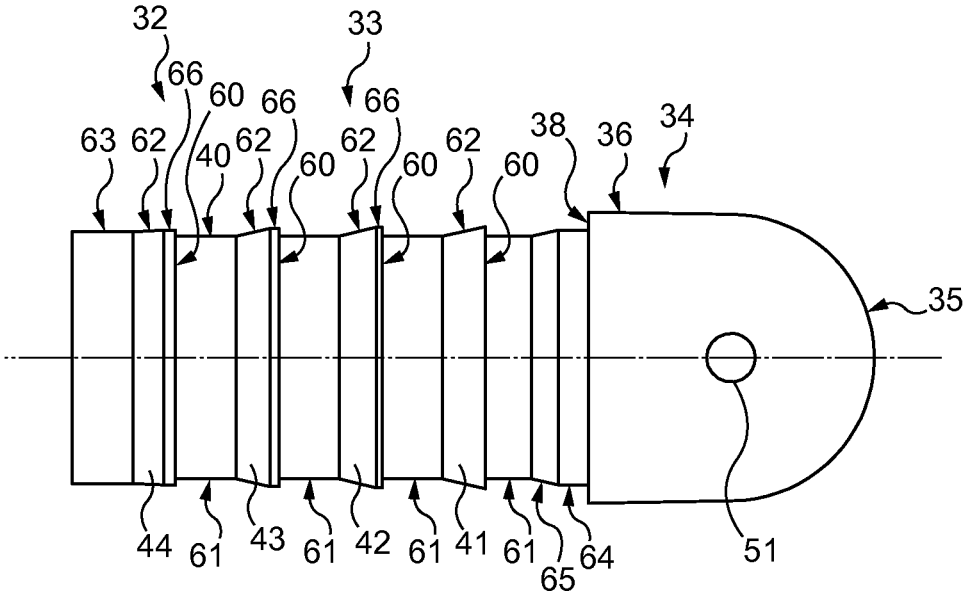

The outside surface 40 of the tail 33 will now be described in more detail with the aid of FIGS. 3 and 4.

Each of the ribs 41 to 44 comprises:

on the side turned towards the distal end (which side can be seen to the right in FIGS. 2 to 4) a straight surface 60, that is to say a surface oriented according a transverse plane, which projects from a trough surface 61; and on the side turned towards the proximal end (which side can be seen to the left in FIGS. 2 to 4), a surface 62 inclined inwardly and towards the proximal end.

Here, the trough surfaces 61 have the same diameter and the inclined surfaces 62 have the same inclination.

The inclined surface 62 of the ribs 41, 42 and 43 is joined to its base (the part of smallest diameter situated on the opposite side to the straight surface 60) at the trough surface 61 from which projects the straight surface 60 of the next rib.

The inclined surface 62 of the rib 44 joins to its base at a guide surface 63 of which the diameter is slightly greater than the diameter of the trough surfaces 61.

The base surface of the shoulder 38 of the head 34 joins to a wedging surface 64 of which the diameter is slightly greater than the diameter of the guide surface 63.

Between the wedging surface 64 and the nearest trough surface 61, is located a transition surface 65 which is inclined inwardly and towards the distal end.

The outside diameter of the ribs 41 to 44, which here corresponds to the greatest diameter of the straight surfaces 60 and of the inclined surfaces 62, varies from one rib to the other, increasing from the proximal end of the tail 33.

Thus, the outside diameter of the annular rib 44, which is the closest to the proximal end, is smaller than the outside diameter of the rib 43, which is itself smaller than the outside diameter of the rib 42, which is itself smaller than the outside diameter of the rib 41.

The straight surface 60 and the inclined surface 62 of the rib 41 meet.

For each of the ribs 42, 43 and 44, there is, between the straight surface 60 and the inclined surface 62, a cylindrical surface 66 having the outside diameter of the corresponding rib.

A description will now be given of how the tube 31 and the tip 32 are attached to each other.

First the tail 33 of the tip 32 is fitted by insertion in an end portion of the tube 31 until the rim 39 comes opposite the shoulder 38.

The diameter of the inside surface 45 of the tube 31 is capable of varying to a relatively great extent, for example by 0.1 mm, due to its manufacture by extrusion.

The ribs 41 and 44 have been configured accordingly:

when the diameter of the inside surface 45 is at the maximum of the range of variation, the inside surface 45 comes at least into contact with the rib 41; and when the diameter of the inside surface 45 is at the minimum of the range of variation, the inside surface 45 comes into contact with each of the ribs 41 to 44.

The fact that the outside diameter of the ribs 41 to 44 increases from the proximal end facilitates the insertion of the tail 33 into the tube 31.

The surface 63 gives first guidance along the inside surface 45 before the latter encounters the rib 44.

When the tip 32 is inserted into the terminal portion of the tube 31, the surface 64 stabilizes the inside surface 45 in the neighborhood of the shoulder 38.

Once the tail 33 of the tip 32 has been inserted into the terminal portion of the tube 31, peripheral clamping on the outside surface 37 of the tube 31 is carried out opposite the ribs 41 to 44 and a sonotrode for ultrasonic welding is applied to the outside surface of the head 34.

Because the only location at which there is clamping between the surface of the tip 32 and the surface of the tube 31 is opposite the ribs 41 to 44, and because of the fact that those ribs form an edge, it is at the zone of contact between the ribs 41 to 44 (periphery of those ribs) and the tube 31 that their materials will heat up, soften and mix, which, after cooling, will form an intrinsic weld, that is to say involving only the material of the tube 31 and the material of the tip 32.

Of course, the material of the tube 31 and the material of the tip 32 are selected so they can be welded ultrasonically and more generally intrinsically, that is to say that those materials are mixable when they are have been softened.

Here, the material of the tube 31 and the material of the tip are transparent. They are respectively PVC (poly vinyl chloride) and PMMA (poly methyl methacrylate).

In principle, the ribs 41 to 44 are configured such that each of them is welded to the tube 31.

Given the difference in diameters of the ribs 41 to 44, the depth of weld increases from the proximal end, that is to say that the depth of weld between the rib 44 and the tube 31 is smaller than the depth of weld between the rib 43 and the tube 31 which is itself smaller than the depth of weld between the rib 42 and the tube 31 which is itself smaller than the depth of weld between the rib 41 and the tube 31, as can be seen in FIG. 2.

When the diameter of the inside surface 45 is very great, the weld will be made at least with the rib of greatest diameter, that is to say the rib 41.

It should be noted that the welds between the tip 32 and the tube 31 are made exclusively at the location of the ribs 41 to 44.

In particular, there is no weld between the shoulder 38 of the tip 32 and the rim 39 of the tube 31.

This makes it possible to avoid weld flash projecting from the outside surface of the tube 31 or from the head 34; and the risks of injuries to the animal, which could be caused by such a weld flash, are thus avoided.

On the contrary, in a general manner, as the welds are exclusively internal to the sheath 30 those risks are eliminated.

In a variant not illustrated, the number of annular ribs of the outside surface of the tail and the tip is different from four, for example two or five.

In another variant not illustrated, the duct internal to the tip such as 32 is differently conformed, for example being oriented uniquely in the axial direction, while opening by the center of the surface such as 35.

Numerous other variants are possible according to circumstances, and in this connection it is to be noted that the invention is not limited to the examples described and shown.

The invention claimed is:

1. A sanitary sheath for a syringe for insemination by straw (10), comprising a tube (31) and a tip (32) attached to the tube (31), which tip comprises a tail (33) inserted into an end portion of the tube (31) and a head (34) disposed in line with the tube (31), said tip (32) comprising a duct opening into the tube (31) at a proximal end of the tail (33) and out from the sheath at an outside surface (35, 36) of the head (34), the duct comprising an axially oriented portion (53) narrowing from the proximal end of the tail (33), said tail (33) comprising on its outside surface (40) a plurality of annular ribs (41-44) facing the inside surface (45) of the tube (31), said head (34) comprising a shoulder (38) facing a rim (39) of the tube (31) and jutting relative to a base of the tail (33); wherein the tip (32) and the tube (31) are exclusively fastened by intrinsic welding exclusively at the periphery of one or more said annular ribs (41-44).

2. A sanitary sheath according to claim 1, wherein the tip (32) and the tube (31) are welded at a location of several of said annular ribs (41-44), with a different depth of weld for at least two said annular ribs (41-44).

3. A sanitary sheath according to claim 2, wherein the depth of weld is greater the further the annular rib (41-44) is from the proximal end of the tail (33) of the tip (32).

4. A sanitary sheath according to claim 1, wherein each said annular rib (41-44) comprises, on a side turned towards a distal end, a straight surface (60) which projects from a trough surface (61); and from a side turned towards the proximal end, a surface (62) inclined inwardly and towards the proximal end.

5. A method for manufacturing a sanitary sheath according to claim 1, further comprising:

providing a tube (31) and a tip (32) comprising a tail (33) and a head (34), said tip comprising a duct opening at the proximal end of the tail (33) and at the outside surface (35, 36) of the head (34), which duct comprises an axially oriented portion narrowing from the proximal end of the tail (33), said tail (33) comprising on its outside surface (40) a plurality of annular ribs (41-44), said head comprising a shoulder (38) jutting relative to the base of the tail (33);

inserting the tail (33) into an end portion of the tube (31) until the head (34) is disposed in line with the tube (31), the annular ribs (41-44) then facing the inside surface (45) of the tube (31), the rim (39) of the tube (31) facing said shoulder (38);

performing peripheral clamping on the outside surface (37) of the tube (31) opposite said ribs (41-44); and applying a sonotrode for ultrasonic welding to the outside surface (35-36) of the head (34).

6. A method according to claim 5, wherein an outside diameter of said annular ribs (41-44) varies from one rib to another rib, increasing from the proximal end of the tail (33).

* * * * *